US006534934B1

(12) United States Patent
Lin et al.

(10) Patent No.: US 6,534,934 B1
(45) Date of Patent: Mar. 18, 2003

(54) MULTI-LAMP DRIVING SYSTEM

(75) Inventors: Wei-Hong Lin, Hsinchu (TW); Chia-Yuan Chen, Hsinchu (TW); Deng-Kang Chang, Hsinchu (TW); Cheng-Chia Hsu, Hsinchu (TW)

(73) Assignee: Ambit Microsystems Corp. (TW)

( * ) Notice: Subject to any disclaimer, the term of this patent is extended or adjusted under 35 U.S.C. 154(b) by 0 days.

(21) Appl. No.: 09/929,340

(22) Filed: Aug. 15, 2001

(30) Foreign Application Priority Data

Mar. 7, 2001 (TW) ..... 90105249 A

(51) Int. Cl.[7] ..... H05B 37/00

(52) U.S. Cl. ..... 315/312; 315/307; 315/324; 315/291

(58) Field of Search ..... 315/307, 310, 315/311, 312, 291, 224, 324

(56) References Cited

U.S. PATENT DOCUMENTS 5,063,331 A * 11/1991 Nostwick ..... 315/209 R
5,424,614 A * 6/1995 Maheshwari ..... 315/209 R
5,438,243 A * 8/1995 Kong ..... 315/219
6,060,843 A * 5/2000 Primisser et al. ..... 315/194
6,137,239 A * 10/2000 Wu et al. ..... 315/291
6,181,079 B1 * 1/2001 Chang et al. ..... 315/224
6,236,168 B1 * 5/2001 Moisin ..... 315/219
6,366,029 B1 * 4/2002 Billings ..... 315/209 R
6,420,839 B1 * 7/2002 Chiang et al. ..... 315/224

* cited by examiner

*Primary Examiner*—Tan Ho
(74) *Attorney, Agent, or Firm*—Michael D. Bednarek; Shaw Pittman LLP

(57) ABSTRACT

A system for driving a plurality of lamps is disclosed to balance currents flowing through the lamps by means of impedance matching. According to the multi-lamp driving system of the present invention, a balancing controller is employed to match the impedance of each lamp path so as to regulate currents flowing through the lamps to be substantially the same.

31 Claims, 14 Drawing Sheets

MULTI-LAMP DRIVING SYSTEM

BACKGROUND OF THE INVENTION

1. Field of the Invention

The present invention generally relates to a lamp driving system. More particularly, the present invention relates to a multi-lamp driving system in the application of the backlight module of a liquid crystal display.

2. Description of the Related Art

A discharge lamp used to backlight an LCD panel such as a cold cathode fluorescent lamp (CCFL) has terminal voltage characteristics that vary depending upon the immediate history and the frequency of a stimulus (AC signal) applied to the lamp. Until the CCFL is struck or ignited, the lamp will not conduct a current with an applied terminal voltage that is less than the strike voltage, e.g., the terminal voltage must be equal to or greater than 1500 Volts. Once an electrical arc is struck inside the CCFL, the terminal voltage may fall to a run voltage that is approximately ⅓ the value of the strike voltage over a relatively wide range of input currents. For example, the run voltage could be 500 Volts over a range of 500 microAmps to 6 milliAmps for a CCFL that has a strike voltage of 1,500 Volt. Usually, the CCFL is driven by AC signals having frequencies that range from 30 KiloHertz to 100 KiloHertz.

The discharge lamp exhibits a negative impedance characteristic that the equivalent impedance is decreased upon an increase of input power. Therefore, a circuit for providing the lamp with power, such as an inverter, should be configured with a controllable alternating current power supply and a feedback loop for monitoring the current flowing through the lamp to ensure stable operation and make load regulation as well.

Referring to FIG. 1, a conventional lamp driving system is schematically depicted. The system of FIG. 1 has only one feedback loop used for controlling the total current flowing through a lamp or lamps, but not used for controlling or balancing those currents flowing througheach lamp. If the current through one lamp is significantly larger than others, the lamp will be shortened in lifetime and the LCD panel will be degraded in brightness uniformity.

Referring to FIG. 2, another conventional lamp driving system is schematically depicted. However, the system of FIG. 2 is configured with two sets of control circuits resulting in an increase of cost and space.

Referring to FIG. 3, further another conventional driving system is schematically depicted. However, the system of FIG. 3 has two transformers also resulting in an increase of cost and space. Moreover, the transformers are configured with secondary coils connected in parallel to be adverse to high-voltage processing.

SUMMARY OF THE INVENTION

It is therefore an object of the present invention to provide a lamp driving system for controlling the balance of currents at load end, which can be extensively applied to a system with single feedback loop and multiple loads.

It is another object of the present invention to provide a lamp driving system with cost efficiency, compact space and simplified manufacturing.

It is further another object of the present invention to provide a lamp driving system for controlling the balance of currents precisely.

To achieve aforementioned objects, the present invention provides a multi-lamp driving system comprising: an inverter for generating an AC power, a lamp set having a first lamp and a second lamp, and a balancing controller coupled with the inverter and the lamp set for balancing currents flowing through the first lamp and the second lamp. The balancing controller comprises: a first load coupled with the first lamp and the inverter, a second load coupled with the second lamp and the inverter, and a third load coupled with the first load and the second load, wherein the impedance ratio of the third load to the first load is negative.

Moreover, the present invention provides a multi-lamp driving system comprising: an inverter for generating an AC power, a lamp set having a plurality of lamps, and a balancing controller coupled with the lamp set and the inverter for balancing currents flowing through the plurality of lamps. The balancing controller comprises: a plurality of loads, each of which is coupled with one of the plurality of lamps and the inverter; and a load choke coupled with the plurality of loads to balance currents flowing through the plurality of lamps.

BRIEF DESCRIPTION OF DRAWINGS

The following detailed description, given by way of examples and not intended to limit the invention to the embodiments described herein, will best be understood in conjunction with the accompanying drawings, in which.

DETAILED DESCRIPTION OF THE INVENTION

Figure 1:
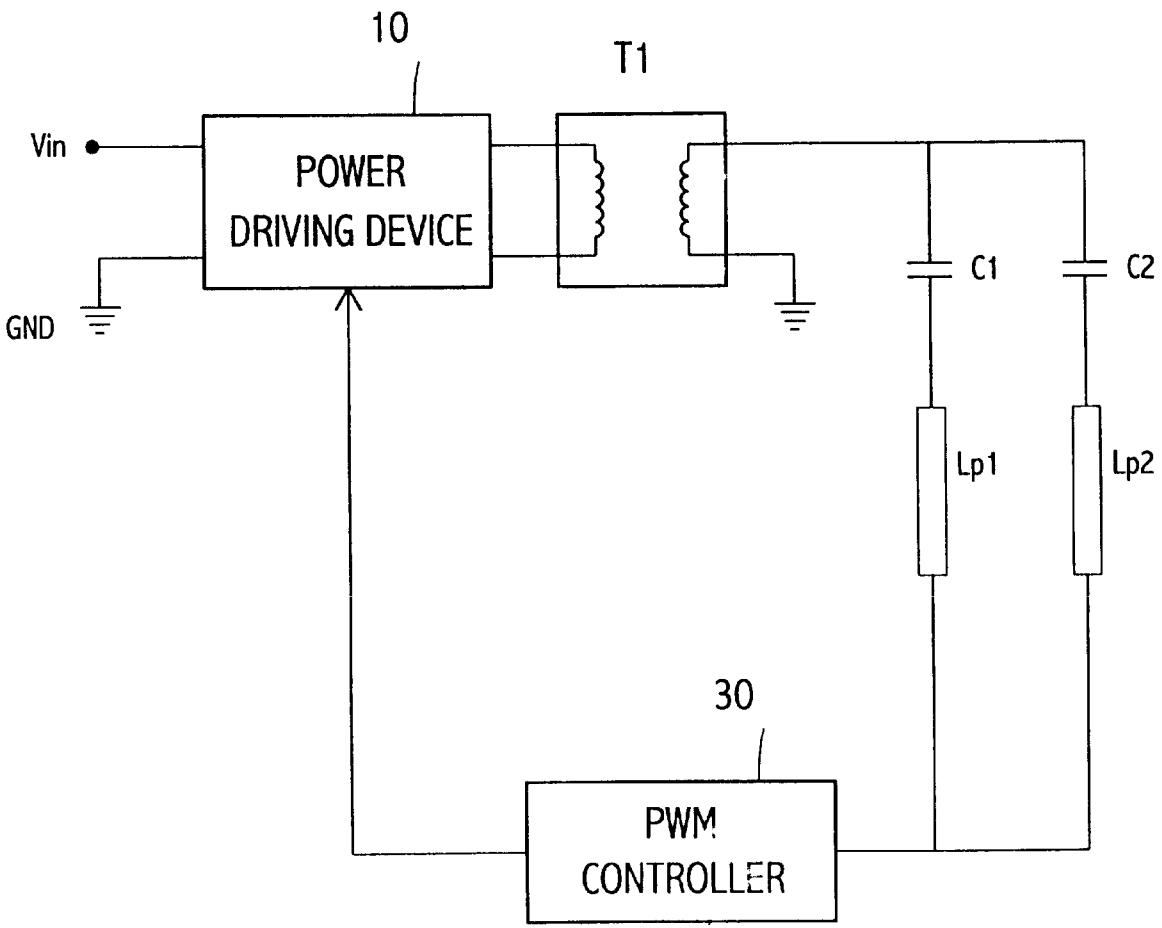
FIGURE 1 (PRIOR ART)
FIG. 1 schematically depicts a conventional lamp driving system.
Figure 2:
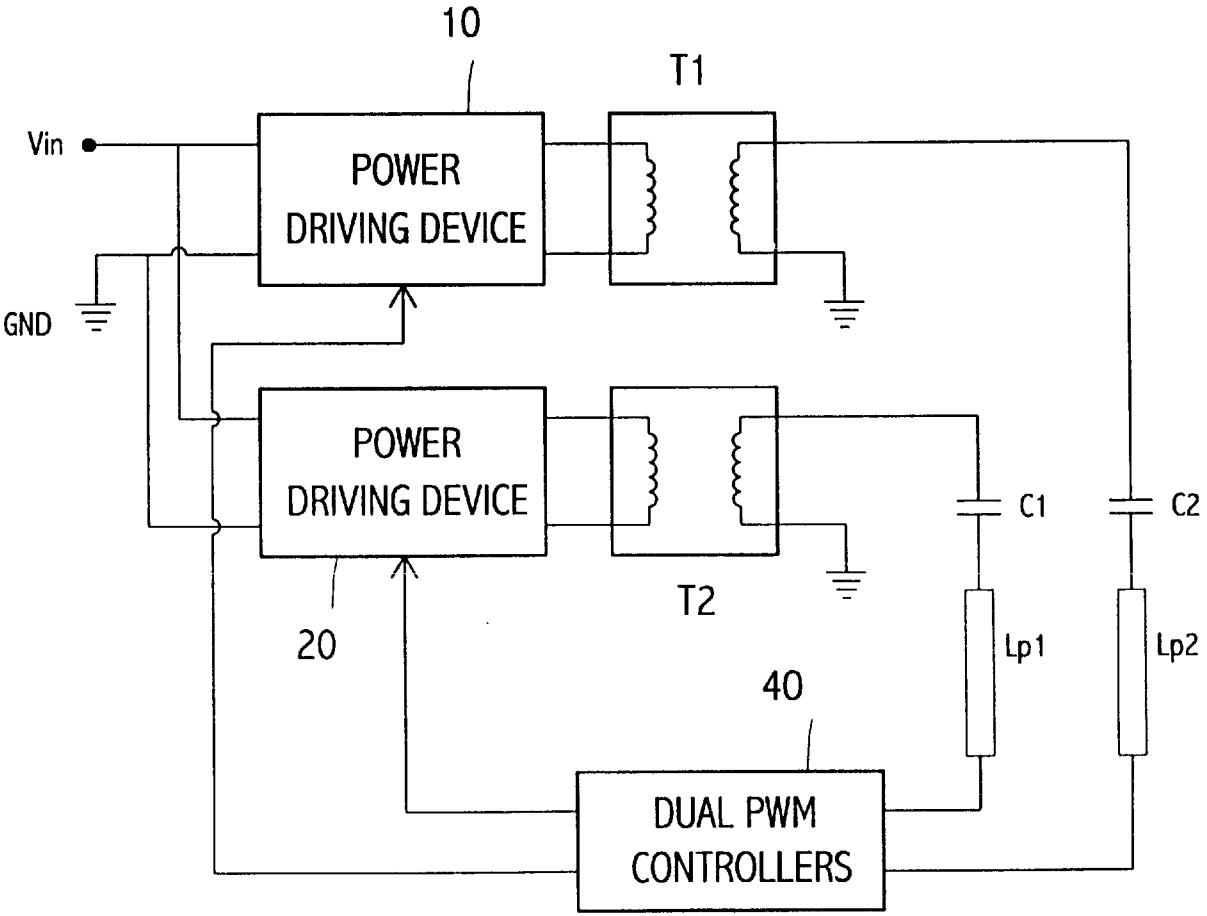
FIGURE 2 (PRIOR ART)
FIG. 2 schematically depicts another conventional lamp driving system.
Figure 3:
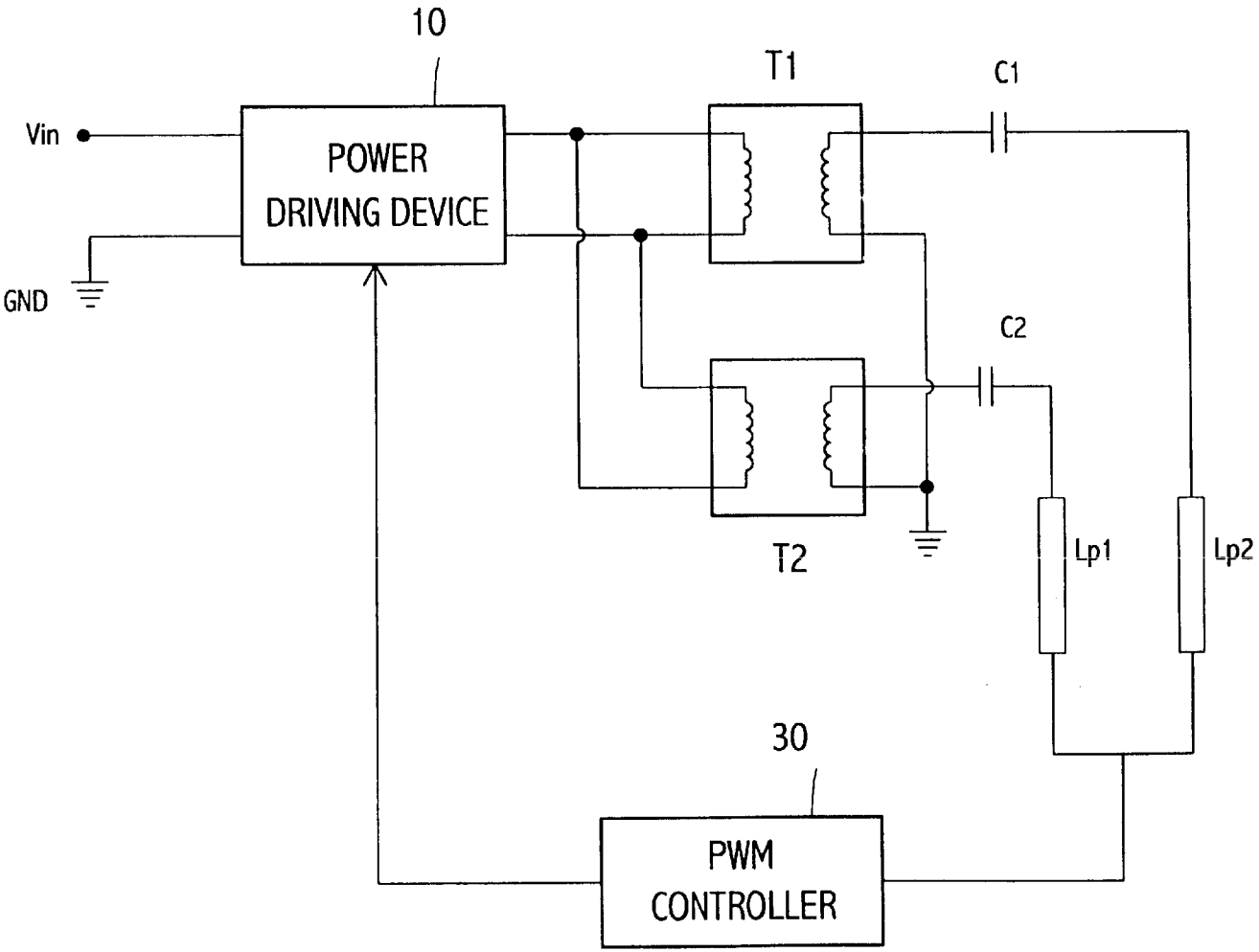
FIGURE 3 (PRIOR ART)
FIG. 3 schematically depicts further another conventional lamp driving system.
Figure 4:
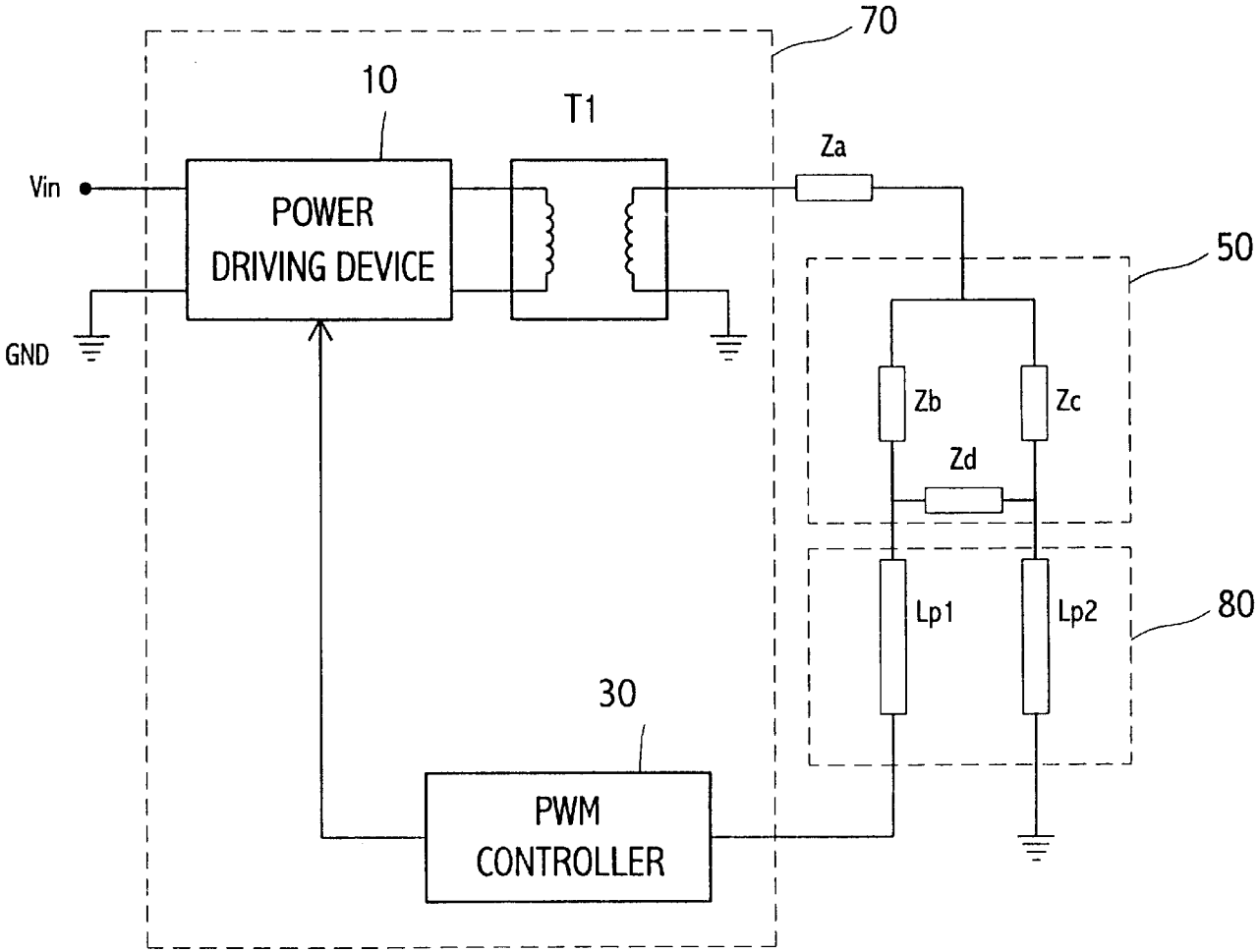
FIG. 4 schematically depicts the first preferred embodiment of a lamp driving system in accordance with the present invention.

Referring to FIG. 4, the first preferred embodiment of a lamp driving system in accordance with the present invention is schematically depicted. In FIG. 4, the lamp driving system comprises an inverter 70, a lamp set 80 and a balancing controller 50. The inverter 70 is provided with a power driving device 10, a transformer T1 and a PWM controller 30. The lamp set 80 is constituted by lamps Lp1 and Lp2, and the balancing controller 50 is constituted by loads Zb, Zc and Zd.

The power driving device 10 is employed to convert a DC power Vin into an AC power which is stepped up by the transformer T1 and then provided for the lamp set 80. The PWM controller 30 controls the power driving device in response to a feedback signal generated from the lamp set 80. According to the first preferred embodiment of the present invention, the balancing controller 50 is used to regulate currents flowing through the lamps Lp1 and Lp2 to be substantially the same. The loads Za, Zb, Zc and Zd can be the combinations of resistors, capacitors, inductors, transistors or integrated circuits. The operation of the balancing controller 50 is based upon the impedance regulation of the loads Zb, Zc and Zd for the purpose of balancing load currents. The impedance regulation can be made in a linear or digital manner.

Figure 5:
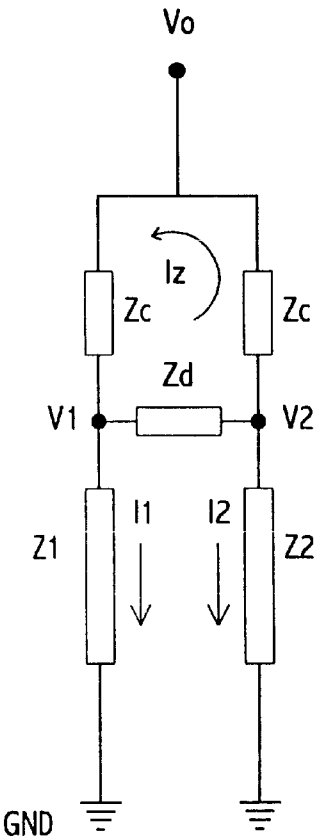
FIG. 5 schematically depicts the balancing controller of FIG. 4.

FIG. 5 is utilized to explain the operations of the balancing controller 50 of FIG. 4.

Assume that Za=0, Zb=Zc, Lp1=Z1 and Lp2=Z2, V12=I1Z1−I2Z2, and $$Iz=(1/Zd)(I1Z1-I2Z2) \quad (1)$$

$$V0=I1(Z1+Zc)+IzZc \quad (2)$$

$$V0=I2(Z2+Zc)-IzZc \quad (3)$$

From equations (2) and (3), $$I1(Z1+Zc)+IzZc=I2(Z2+Zc)-IzZc$$

$$I1(Z1+Zc)+2IzZc=I2(Z2+Zc)$$

$$I1(Z1+Zc)+(2Zc/Zd)\ (I1Z1-I2Z2)=I2(Z2+Zc)$$

$$I1(Z1+Zc+2Z1Zc/Zd)=I2(Z2+Zc+2Z2Zc/Zd)$$

$$\text{If } (Z1+Zc+2Z1Zc/Zd)=(Z2+Zc+2Z2Zc/Zd),\ I1=I2$$

$$(2Zc/Zd)(Z1-Z2)=Z2-Z1$$

$$2Zc/Zd=(-1)$$

Thus, I1=I2 can conform to the requirement of current balancing if Zc/Zd is chosen to be(−½).

If capacitance C and inductance L are utilized to the loads Zc and Zd respectively, at an operating frequency ω, $$Zc/Zd=(1/j\omega C)/(j\omega L)=-1/(\omega^2 LC)=-½$$

$$1/LC=\omega^2/2$$

In other words, the purpose of current balancing can be attained if $1/LC=\omega^2/2$.

Figure 10C:
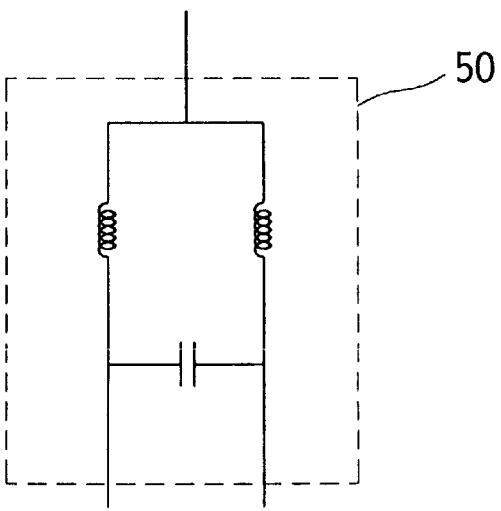
FIGS. 10A to 10C schematically depict various circuit configurations of the balancing controller according to the present invention.
Figure 10B:
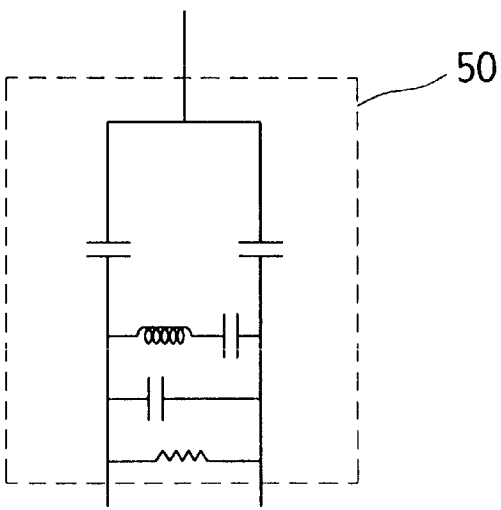
Figure 10A:
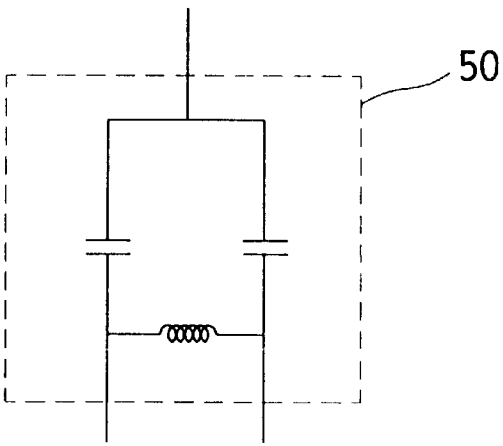

According to the present invention, current balancing can be achieved by means of impedance matching. In addition, the balancing controller 50 of FIG. 4 can be replaced by the the combination of capacitors and an inductor as shown in FIG. 10A. Moreover, the balancing controller 50 can be the combination of capacitors, an inductor and a resistor as shown in FIG. 10B. Furthermore, other example of the balancing controller 50 can be the combinations of inductors and a capacitor as shown in FIG. 10C. Accordingly, those currents flowing through the lamps Lp1 and Lp2 can be substantially the same when the ratio Zc/Zd is (−½).

Moreover, as long as the equivalent impedance ratio Zc/Zd is properly designed to be a negative ratio, the current difference between the lamps can be effectively reduced. As an example, $$I1(Z1+Zc+2Z1Zc/Zd)=I2(Z2+Zc+2Z2Zc/Zd)$$

$$I1/I2=(Z2+Zc+2Z2Zc/Zd)/(Z1+Zc+2Z1Zc/Zd)$$

Assume Z1=10, Z2=11, Zc=−10j and Zd=15j (Zc/Zd=−1/1.5), $$I1/I2=(11-10j+2*11*(-10j)/15j)/(10-10j+2*10*(-10j)/15j)=(11-10j-14.67)/(10-10j-13.33)=(3.67+10j)/(3.33+10j)=(10.65\angle\theta1)/(10.54\angle\theta2)$$

Accordingly, the current error (I1-I2)/I1 can be reduced by 1% (without taking phase into account). Thus, current difference between the lamps can be effectively reduced as long as the equivalent impedance ratio Zc/Zd is negative.

Figure 6:
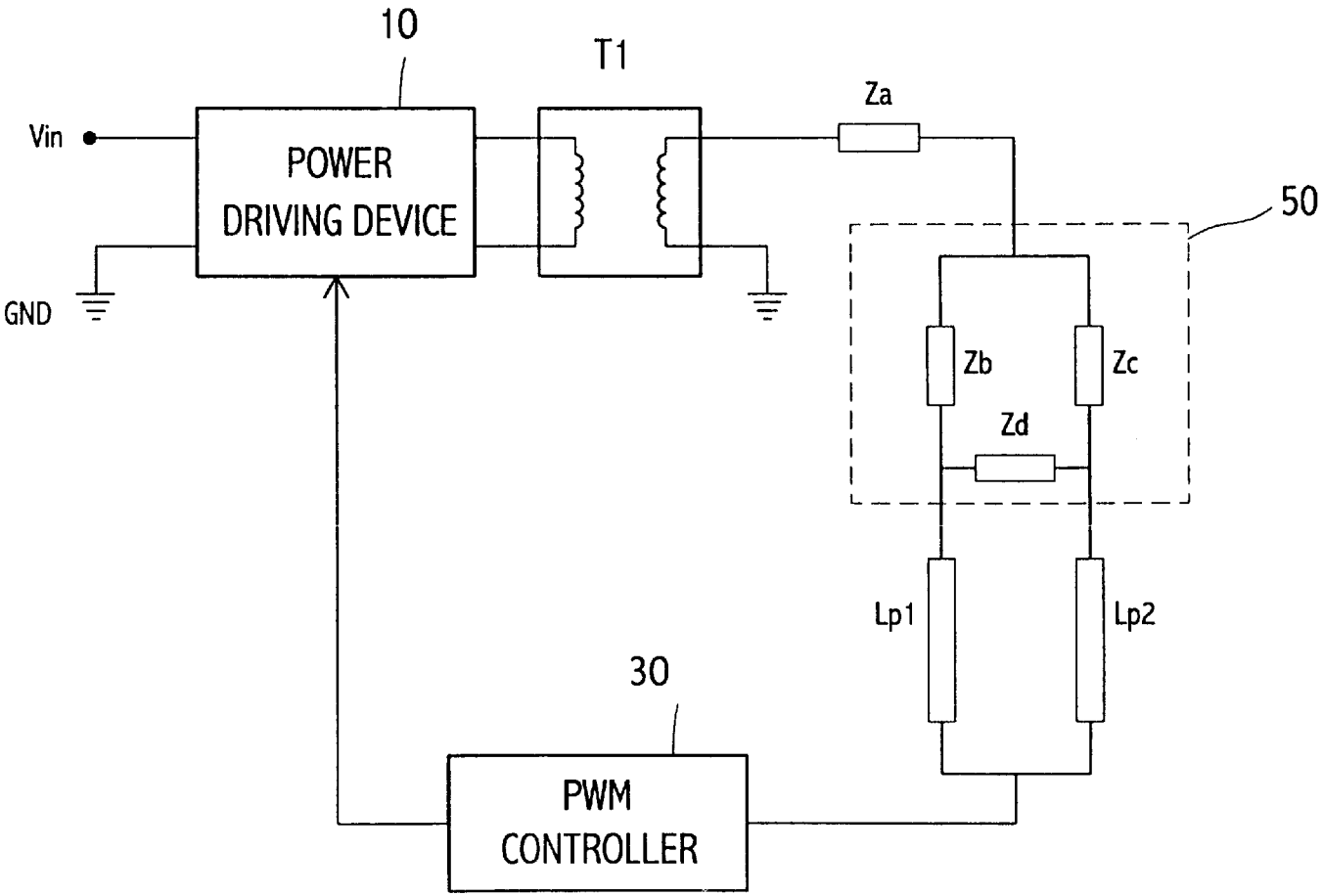
FIG. 6 schematically depicts the second preferred embodiment of a lamp driving system in accordance with the present invention.

Referring to FIG. 6, the second preferred embodiment of a lamp driving system in accordance with the present invention is schematically depicted. The circuit of FIG. 6 is similar to that of FIG. 5, but having difference in current feedback signals provided for the PWM controller 30. In FIG. 5, the feedback signal provided for the PWM controller 30 is responsive to the current flowing through the lamp Lp1, but the feedback signal provided for the PWM controller 30 is responsive to the currents flowing through the lamps Lp1 and Lp2.

Figure 7:
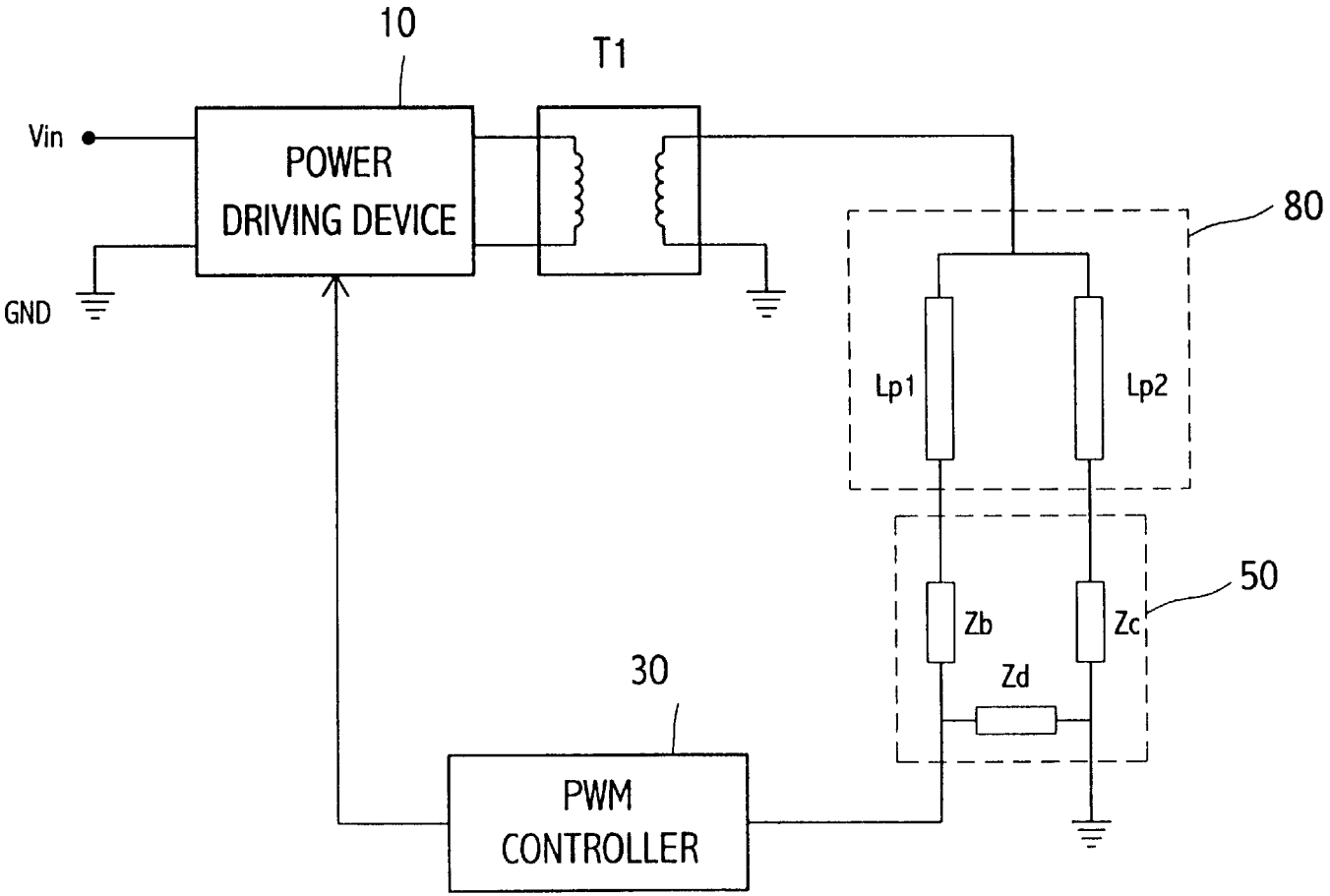
FIG. 7 schematically depicts the third preferred embodiment of a lamp driving system in accordance with the present invention.

Referring to FIG. 7, the third preferred embodiment of a lamp driving system in accordance with the present invention is schematically depicted. In this embodiment, the balancing controller 50 is connected between the lamp set 80 and the PWM controller 30.

Figure 8:
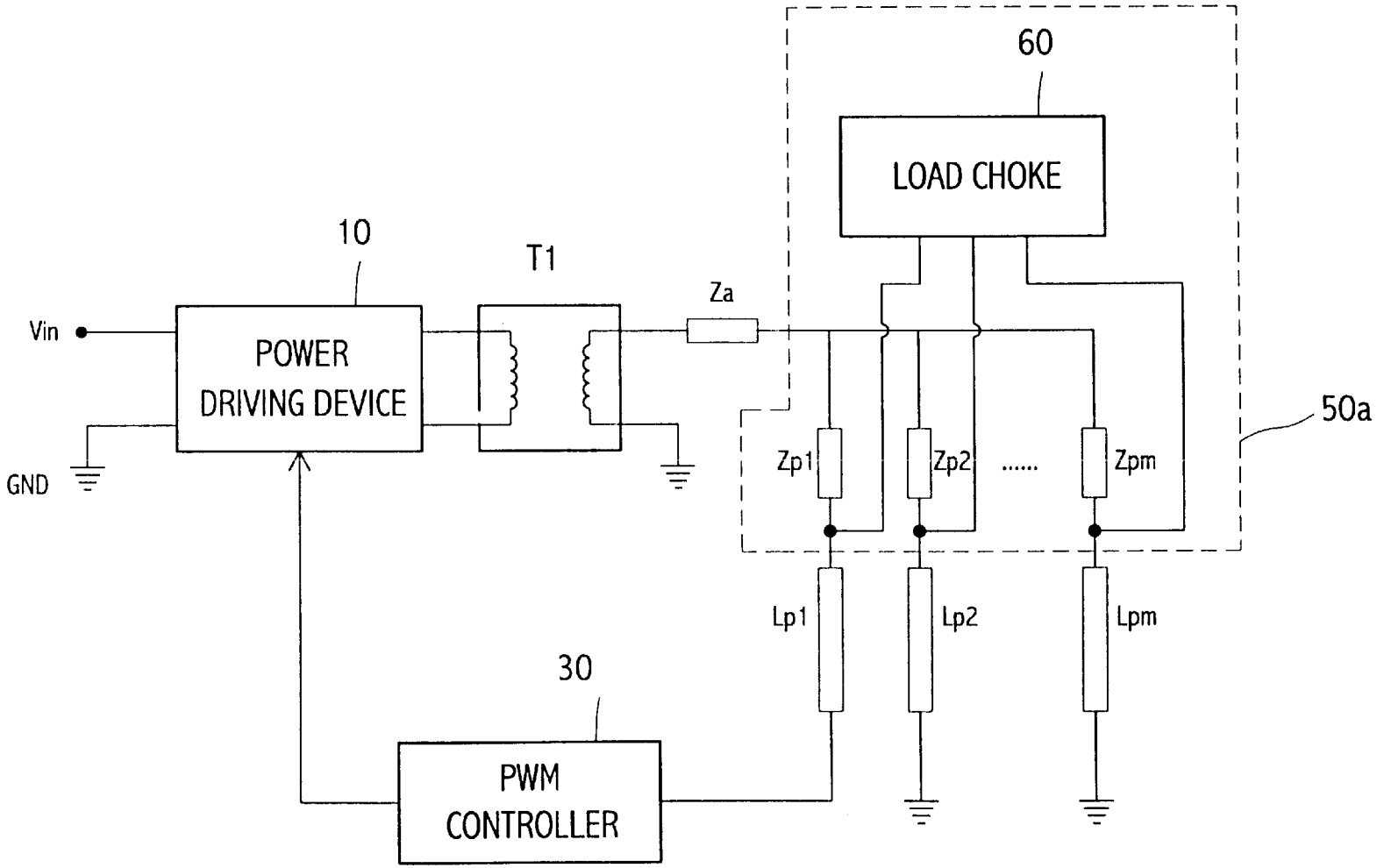
FIG. 8 schematically depicts the fourth preferred embodiment of a lamp driving system in accordance with the present invention.

Referring to FIG. 8, the fourth preferred embodiment of a lamp driving system in accordance with the present invention is schematically depicted. In this case, a load choke 60 is employed to regulate load balance of whole circuitry. According to the fourth embodiment of the present invention, the balancing controller 50*a* comprises loads Zp1, Zp2, . . . , Zpm and the load choke 60. The impedance relation of the load choke 60 and the loads Zp1, Zp2, . . . , Zpm can be found upon the formulae as mentioned above.

Figure 9:
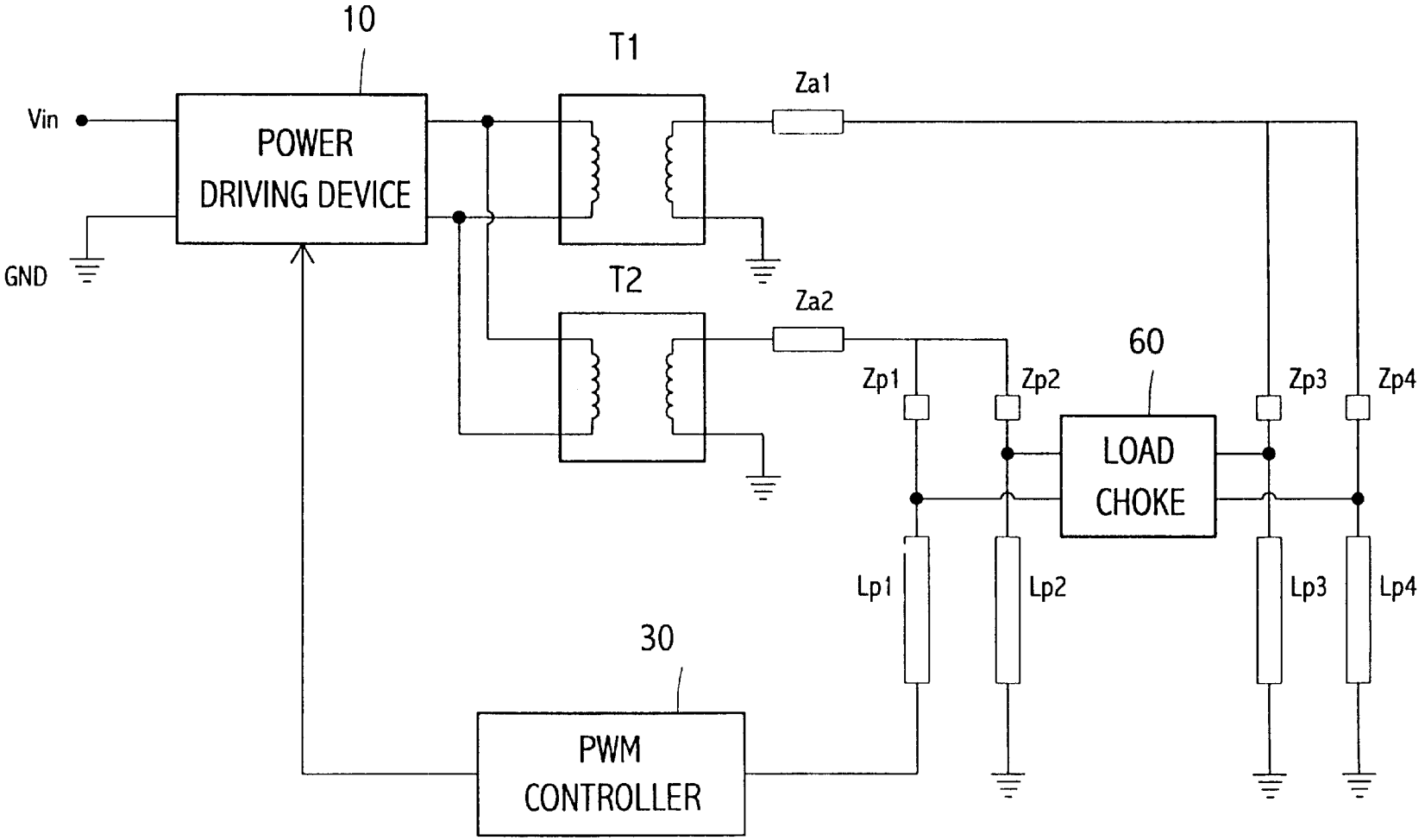
FIG. 9 schematically depicts the fifth preferred embodiment of a lamp driving system in accordance with the present invention.

Referring to FIG. 9, the fifth preferred embodiment of a lamp driving system in accordance with the present invention is schematically depicted. A load choke 60 of Figure functions as that of FIG. 6. However, the fifth preferred embodiment could be applied to an inverter provided with multiple transformers.

Figure 11:
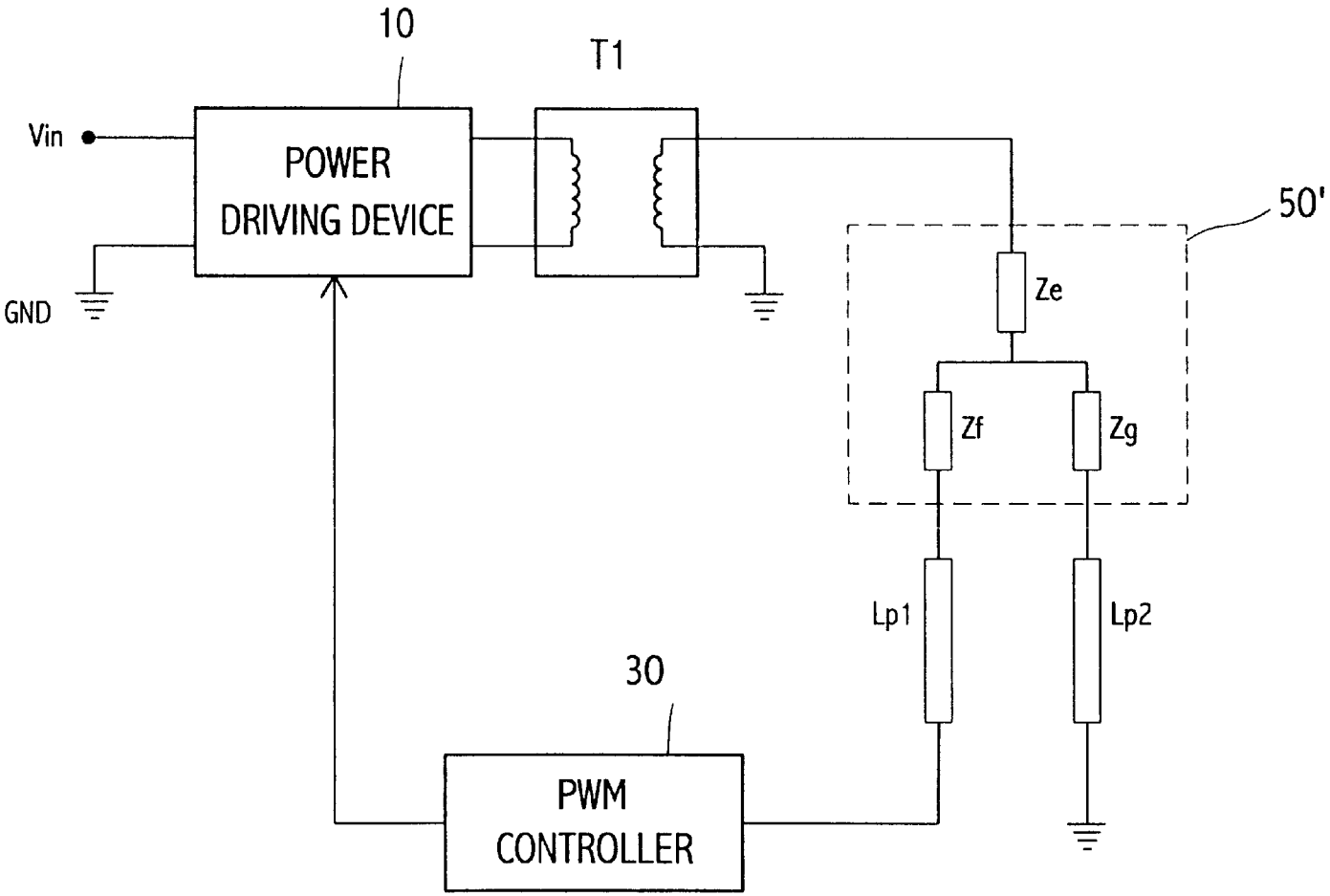
FIG. 11 schematically depicts the sixth preferred embodiment of a lamp driving system in accordance with the present invention.

Referring to FIG. 11, the sixth preferred embodiment of a lamp driving system in accordance with the present invention is schematically depicted. The circuit of FIG. 11 is similar to that of FIG. 4 except that the balancing controller 50 in FIG. 4 is replaced by the balancing controller 50' in FIG. 11 by performing a Δ-Y transform. Specifically, the Δ-circuit consisting of loads Zb, Zc and Zd in the balancing controller 50 of FIG. 4 is transformed to a Y-circuit consisting of loads Zb, Zc and Zd in the balancing controller 50' of FIG. 11 by applying a Δ-Y transform. The Load Ze is seriesly connected to the load Za while the loads Zf and Zg are seriesly connected to the lamps Lp1 and Lp2 respectively.

Recalling that, as was mentioned earlier, it is assumed Za=Zc, Zc/Zd and Zb/Zd are both negative, and preferably Zc/Zd=Zb/Zd=(−½) in the embodiment of FIG. 4, the values of loads Ze, Zf and Zg in the equivalent circuit can therefore be derived from the following equations:

$$Ze=ZbZc/(Zb+Zc+Zd)=Zc^2/2Zc+Zd$$

$$Zf=ZbZd/(Zb+Zc+Zd)=ZcZd/2Zc+Zd$$

$$Zg=ZcZd/(Zb+Zc+Zd)=ZcZd/2Zc+Zd$$

Figure 13B:
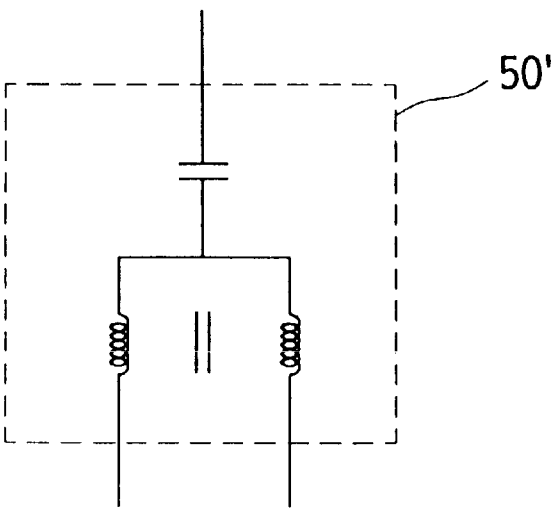
FIGS. 13A to 13B schematically depict two embodiments with their balancing controllers provided at the high-voltage end and low-voltage end respectively.
Figure 13A:
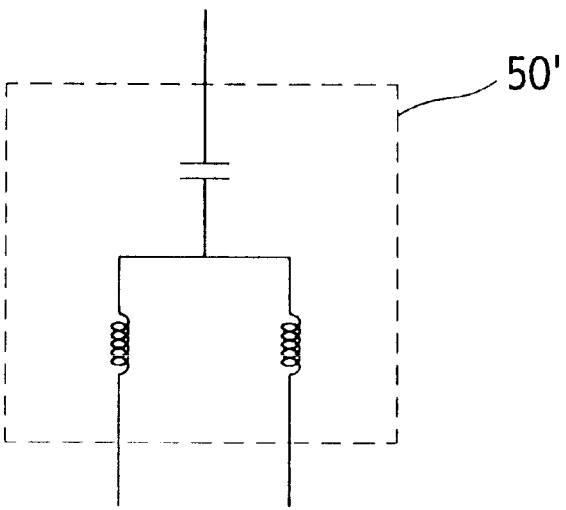
Figure 14:
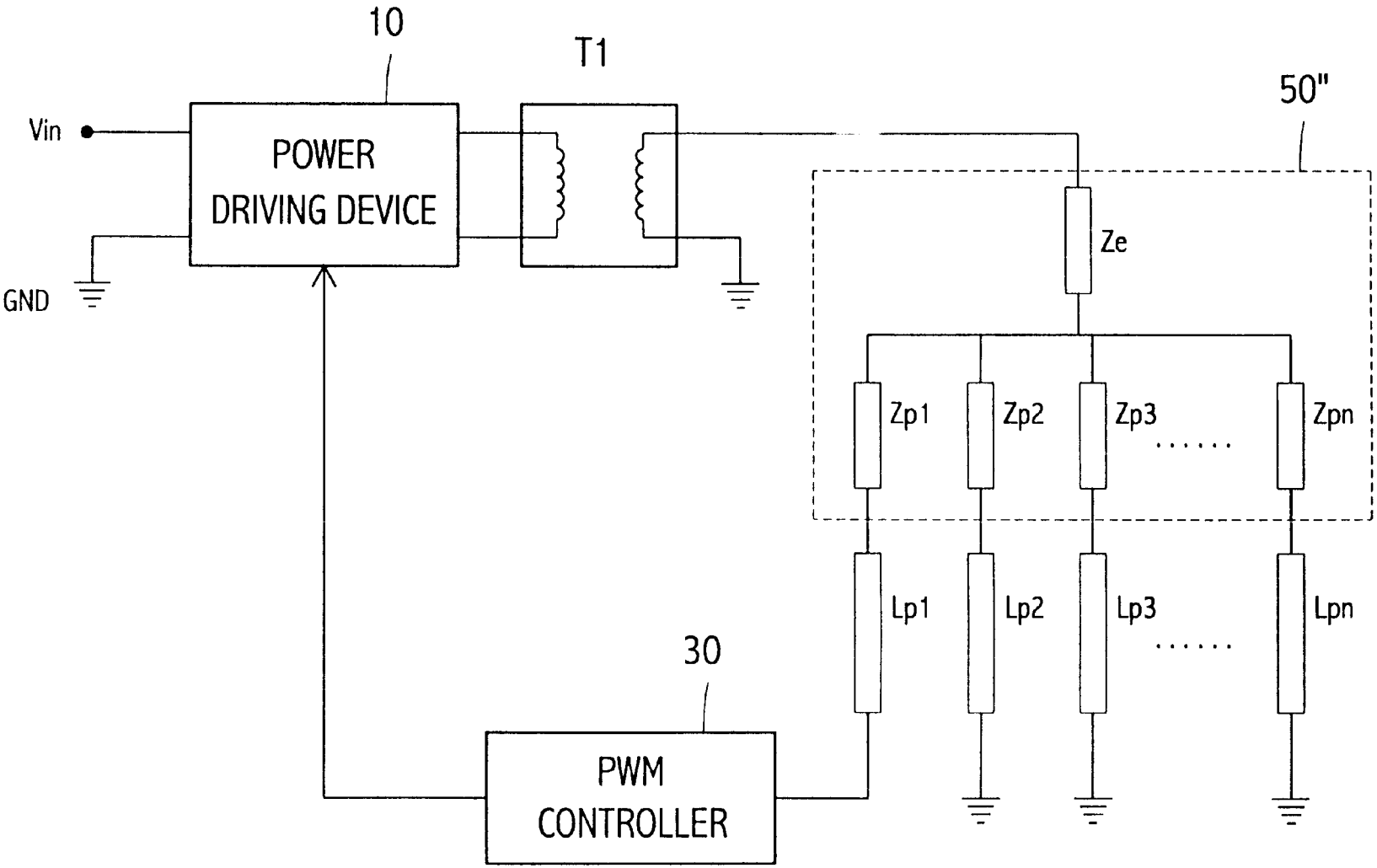
FIG. 14 schematically depicts the eighth preferred embodiment of a lamp driving system in accordance with the present invention.

Accordingly, the load Zf is substantially the same as load Zg, and the impedance ratio of the load Ze to the load Zf is preferably equal to (−½). Thereby, the equivalent Y-type balancing controller 50' exhibits the same operation characteristics as the Δ-type balancing controller 50. Accordingly to the sixth preferred embodiment of the invention, the balancing controller 50' preferably comprises the combination of capacitors and an inductor as shown in FIG. 13A.

Similarly, the balancing controller 50 of the second preferred embodiment in FIG. 6 may also be replaced by the balancing controller 50' in FIG. 7, the description of which is omitted for simplification.

Figure 12:
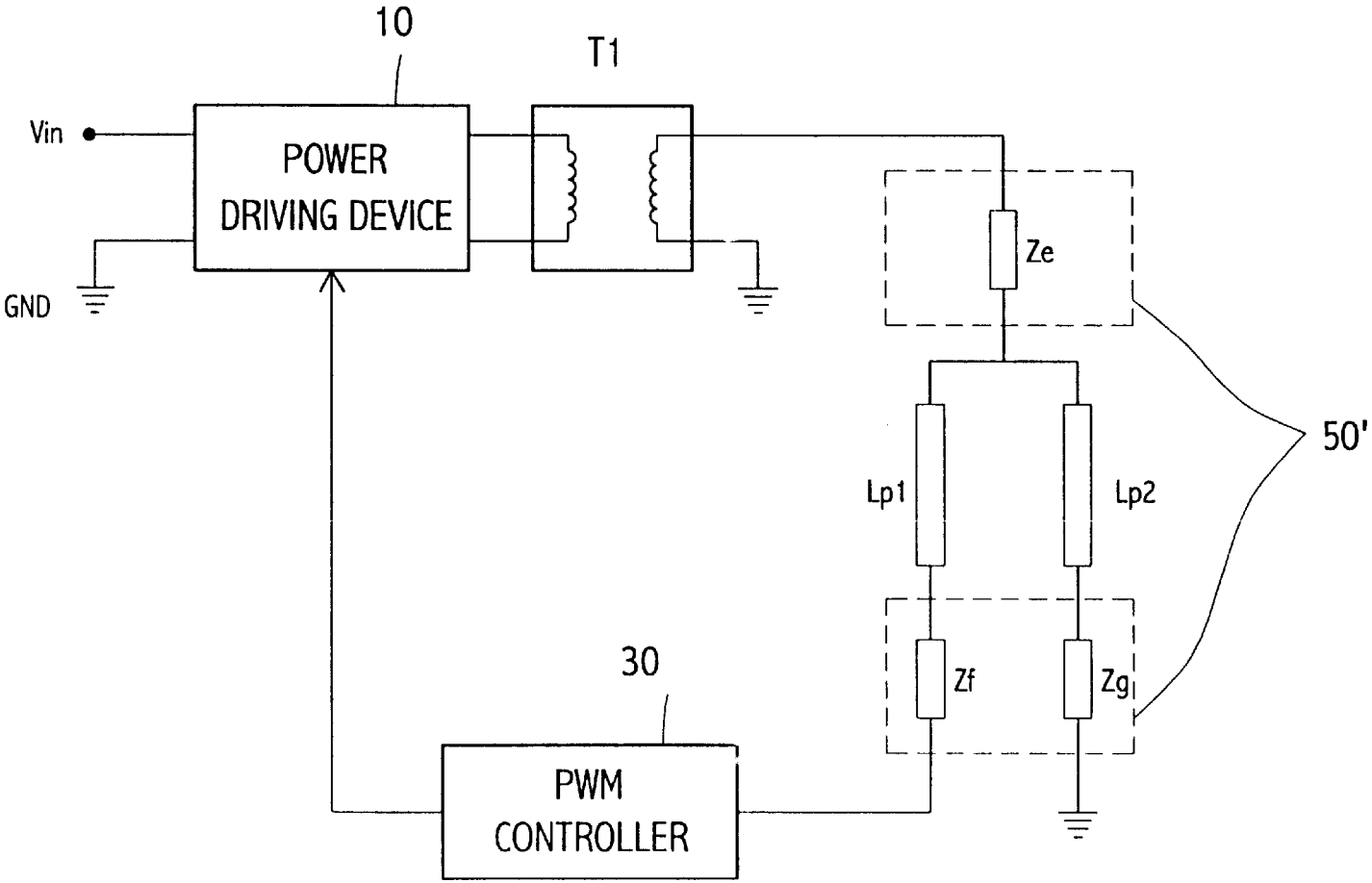
FIG. 12 schematically depicts the seventh preferred embodiment of a lamp driving system in accordance with the present invention.

Referring to FIG. 12, the seventh preferred embodiment of a lamp driving system in accordance with the present invention is schematically depicted. In the lamp driving system of the sixth preferred embodiment in FIG. 11, the balancing controller 50' is provided at the high-voltage end of the lamp set. However, according to the seventh preferred embodiment of the invention, the balancing controller 50' may also be provided at the low-voltage end of the lamp set to form the configuration as show in FIG. 12 with the loads Zf and Zg seriesly coupled to the low voltage ends of the lamps Lp1 and Lp2 respectively. The balancing controller 50' of the seventh preferred embodiment preferably comprises the combination of capacitors and an inductor as shown in FIG. 13B.

Referring to FIG. 12, the eighth preferred embodiment of a lamp driving system in accordance with the present invention is schematically depicted. The balancing controller 50" of the eighth preferred embodiment comprises loadx Ze, Zp1, Zp2, . . . , Zpn, wherein impedances of the loads Zp1, Zp2, . . . , Zpn are substantially the same and the impedance ratio of the load Ze to the load Zp1 is negative, for balancing the current passing through each of the lamps Lp1, Lp2, . . . , Lpn. For example, the load Ze is a capacitor and the loads Zp1, Zp2, . . . , Zpn are inductors. Although the loads Zp1, Zp2, . . . , Zpn shown are coupled to the high-voltage end of the lamps Lp1, Lp2, . . . , Lpn; however, similar to the seventh preferred embodiment of FIG. 12, the loads may also be coupled to the low-voltage end of the lamp set in an application having more lamps.

While the invention has been described with reference to various illustrative embodiments, the description is not intended to be construed in a limiting sense. Various modifications of the illustrative embodiments, as well as other embodiments of the invention, will be apparent to those person skilled in the art upon reference to this description. It is therefore contemplated that the appended claims will cover any such modifications or embodiments as may fall within the scope of the invention defined by the following claims and their equivalents.

What is claimed is:

1. A multi-lamp driving system for driving a lamp set having a first lamp and a second lamp, said system comprising:

an inverter for generating an AC power; and a balancing controller electrically coupled with said inverter and said lamp set for balancing currents flowing through said first lamp and said second lamp, said balancing controller comprising:

a first load electrically coupled with said first lamp and said inverter;

a second load electrically coupled with said second lamp and said inverter, said second load having an impedance substantially the same as that of said first load; and a third load electrically coupled with said first load and said second load, wherein the impedance ratio of said third load to said first load is negative.

2. The system as claimed in claim 1, wherein said inverter comprises:

a power driving device for converting a DC power to said AC power;

a transformer electrically coupled with said balancing controller and said power driving device; and a PWM controller electrically coupled with said lamp set and said power driving device for controlling said power driving device in response to a feedback signal generated from said lamp set.

3. The system as claimed in claim 2, wherein said PWM controller is electrically coupled to said first lamp.

4. The system as claimed in claim 2, wherein said PWM controller is electrically coupled with said first lamp and said second lamp.

5. The system as claimed in claim 1, wherein said first load and said second load are capacitive loads, said third load is an inductive load.

6. The system as claimed in claim 5, wherein said third load is a combination of a resistor, an inductor and capacitors.

7. The system as claimed in claim 1, wherein the impedance ratio of said third load to said first load is substantially equal to −2, preferably.

8. The system as claimed in claim 1, wherein said inverter comprises:

a power driving device for converting a DC power to said AC power;

a transformer electrically coupled with said lamp set and said power driving device; and a PWM controller electrically coupled with said balancing controller and said power driving device for controlling said power driving device in response to a feedback signal generated from said balancing controller.

9. The system as claimed in claim 8, wherein said PWM controller coupled to said first load.

10. The system as claimed in claim 8, wherein said PWM controller is electrically coupled with said first load and said second load.

11. The system as claimed in claim 8, said first load and said second load are capacitive loads, said third load is an inductive load.

12. The system as claimed in claim 11, wherein said third load is a combination of a resistor, an inductor and capacitors.

13. A multi-lamp driving system for driving a lamp set having a plurality of lamps, said system comprising:

an inverter for generating an AC power;

a balancing controller electrically coupled with said lamp set and said inverter for balancing currents flowing through said plurality of lamps, said balancing controller comprising:

a plurality of loads, each of which is electrically coupled with one of said plurality of lamps and said inverter and each of which has substantially the same impedance; and a load choke electrically coupled with said plurality of loads to balance currents flowing through said plurality of lamps, wherein the impedance ratio of said load choke to each of said plurality of loads is negative.

14. The system as claimed in claim 13, wherein said plurality of loads are capacitive loads and said load choke is an inductive device.

15. The system as claimed in claim 13, wherein said inverter comprises:

a power driving device for converting a DC power to said AC power;

a transformer electrically coupled with said balancing controller and said power driving device; and a PWM controller electrically coupled with said lamp set and said power driving device for controlling said power driving device in response to a feedback signal generated from said lamp set.

16. The system as claimed in claim 15, wherein said PWM controller is electrically coupled with one of said plurality of lamps.

17. The system as claimed in claim 13, wherein said inverter comprises:

a power driving device for converting a DC power to said AC power;

at least two transformers connected in parallel, said transformers being electrically coupled with said balancing controller and said power driving device, respectively; and a PWM controller electrically coupled with said lamp set and said power driving device for controlling said power driving device in response to a feedback signal generated from said lamp set.

18. A multi-lamp driving system for driving a lamp set having a first lamp and a second lamp, said system comprising:

an inverter for generating an AC power; and a balancing controller for balancing currents flowing through said first lamp and said second lamp, said balancing controller comprising a first load, a second load and a third load, one end of said first load being electrically coupled to one end of said second load and one end of said third load, the other end of said first load being electrically coupled to said inverter, the other end of said second load being electrically coupled to said first lamp, the other end of said third load being electrically coupled to said second lamp, said second load having an impedance substantially the same as that of said third load, and the impedance ratio of said first load to said second load is negative.

19. The system as claimed in claim 18, wherein said inverter comprises:

a power driving device for converting a DC power to said AC power;

a transformer electrically coupled with said balancing controller and said power driving device; and a PWM controller electrically coupled with said lamp set and said power driving device for controlling said power driving device in response to a feedback signal generated from said lamp set.

20. The system as claimed in claim 19, wherein said PWM controller is electrically coupled to said first lamp.

21. The system as claimed in claim 19, wherein said PWM controller is electrically coupled with said first lamp and said second lamp.

22. The system as claimed in claim 18, wherein said first load is a capacitive load, and said second load and said third load are inductive loads.

23. The system as claimed in claim 18, wherein the impedance ratio of said second load to said first load is substantially equal to −2, preferably.

24. A multi-lamp driving system for driving a lamp set having a first lamp and a second lamp, said system comprising:

an inverter for generating an AC power; and a balancing controller for balancing currents flowing through said first lamp and said second lamp, said balancing controller comprising a first load, a second load and a third load, said first load being electrically coupled between said inverter and one end of said lamp set, said second load being electrically coupled between said inverter and the other end of said first lamp, said third load being electrically coupled between said inverter and the other end of said second lamp, said second load having an impedance substantially the same as that of said third load, and the impedance ratio of said first load to said second load is negative.

25. The system as claimed in claim 24, wherein said inverter comprises:

a power driving device for converting a DC power to said AC power;

a transformer electrically coupled with said balancing controller and said power driving device; and a PWM controller electrically coupled with said lamp set and said power driving device for controlling said power driving device in response to a feedback signal generated from said lamp set.

26. The system as claimed in claim 25, wherein said PWM controller is electrically coupled to said second load.

27. The system as claimed in claim 25, wherein said PWM controller is electrically coupled with said second load and said third load.

28. The system as claimed in claim 24, wherein said first load is a capacitive load, and said second load and said third load are inductive loads.

29. The system as claimed in claim 24, wherein the impedance ratio of said second load to said first load is substantially equal to −2, preferably.

30. A multi-lamp driving system for driving a lamp set having a plurality of lamps, said system comprising:

an inverter for generating an AC power; and a balancing controller for balancing currents flowing through said first lamp and said second lamp, said balancing controller comprising a first load and a plurality of second loads;

wherein one end of said first load is electrically coupled to said inverter, the other end of said first load is electrically coupled to one end of each of said second loads, the other end of each of said second loads is electrically coupled to each of said lamps respectively, and the impedance ratio of said first load to said second load is negative.

31. A multi-lamp driving system for driving a lamp set having a plurality of lamps, said system comprising:

an inverter for generating an AC power; and a balancing controller for balancing currents flowing through said first lamp and said second lamp, said balancing controller comprising a first load and a plurality of second loads;

wherein said first load is electrically coupled between said inverter and one end of said lamp set, one end of each of said second loads is electrically couple to the other end of each of said lamps respectively, the other end of each of said second loads is electrically coupled to said inverter, and the impedance ratio of said first load to said second load is negative.

* * * * *